United States Patent [19]

Kukin

[11] Patent Number: 4,804,388

[45] Date of Patent: Feb. 14, 1989

[54] COMBUSTION CONTROL BY ADDITION OF MANGANESE AND MAGNESIUM IN SPECIFIC AMOUNTS

[76] Inventor: Ira Kukin, 45 Edgemont Rd., West Orange, N.J. 07052

[21] Appl. No.: 103,891

[22] Filed: Oct. 2, 1987

[51] Int. Cl.[4] ..... C10L 9/10; C10L 10/04

[52] U.S. Cl. ..... 44/51; 44/603; 44/DIG. 2; 44/DIG. 3; 431/3; 431/4

[58] Field of Search ..... 431/3, 4; 44/51, 4, 44/5, DIG. 3, 2, 603

[56] References Cited

U.S. PATENT DOCUMENTS

| | | | |
|---|---|---|---|
| 2,845,338 | 7/1958 | Ryznar et al. | 44/67 |
| 3,332,755 | 7/1967 | Kukin | 44/67 |
| 3,837,820 | 9/1974 | Kukin | 44/5 |

*Primary Examiner*—William R. Dixon, Jr.

*Attorney, Agent, or Firm*—James & Franklin

[57] ABSTRACT

By providing a combination of manganese and magnesium to the combustion area, where the amounts of the two substances are within certain limits, noxious and undesirable emissions are greatly reduced, internal boiler conditions are greatly improved, and lesser amounts of cold end additives need be employed to obtain still greater improvements.

4 Claims, No Drawings

COMBUSTION CONTROL BY ADDITION OF MANGANESE AND MAGNESIUM IN SPECIFIC AMOUNTS

The present invention relates to a method for improving fuel combustion in furnaces, thereby to greatly improve stack emission problems and to minimize boiler fouling.

There are two general areas where fuel combusion presents problems. One general area involves the nature and amount of chemicals which are discharged into the environment. The substances emitted are often corrosive or otherwise damaging to any surfaces on which they fall. In many instances they are harmful to human or plant life, and in many instances they contribute to the formation of smog. These problems are today very generally recognized as quite serious, and strenuous efforts are being made to reduce the environmental pollution attendant upon combustion. The other general area, boiler fouling as a result of the formation of various substances in the boiler which coat the walls or the tubes of the boiler, constitutes a direct economic problem, since it reduces the efficiency of heat transfer and, when the build-up of materials becomes too great within the boiler, necessitates that the boiler be shut down from time to time for cleaning purposes, an obviously uneconomical procedure.

In general, different fuels present different problems. With sulfur-containing fuels, one of the major problems is the concentration of sulfur dioxide and sulfur trioxide in the stack gases. These compounds are extremely deleterious from a pollution point of view. When fuels contain vanadium in addition to sulfur, the production of undesired sulfur oxides is accentuated; the vanadium, probably in combination with the exposed iron on the tubes in the boiler, is able to catalyze the formation of undesirable sulfur oxides. Since both sulfur and vanadium are present in many of the commonly available industrial fuels, these problems are very pressing from a pollution control standpoint.

One standard approach to minimizing pollution problems is to add various substances to the fuel with a view to having those substances enter into chemical combination with the undesired products of combustion in order to render them less undesirable or more readily removable from the stack emissions. Many different substances have been proposed to this end, including manganese and magnesium, usually introduced into the fuel in the form of compounds such as oxides and hydroxides. It is the manganese and magnesium which are the active ingredients, the oxides and hydroxides being chosen as the addition media because they are more readily available and handleable than the active metals themselves.

With these additives, as with other additives, problems often arise. In some instances the additives, while entering into the expected reactions, also enter into side reactions the products of which present their own individual problems, which sometimes outweigh the problems which are intended to be cured. Also, in some instances particular additives, especially when used in large quantities, cause such fouling of the interior of the boiler as to make them undesirable from an economic point of view. Moreover, all additives are costly, and if especially large amounts of a particular additive are required in order to produce a given improvement the cost may be prohibitive from a commercial point of view.

It has been proposed in the past that certain substances be added to the products of combustion at a relatively low temperature station. In general, insofar as magnesium-containing compounds such as oxides and any effect they may have in improving combustion and in particular in reducing $SO_3$ are concerned, this approach has been considered ineffective, because the magnesium compounds by themselves are too inert to produce the desired result. They are in solid form and must react with gaseous products. Reaction rates in such conditions are generally very low. It had therefore been thought that to use a magnesium compound such as magnesium oxide only in conjunction with cold end feed would require so much MgO that particulate matter would escape from the stack in tremendous volume, and a pollution problem would be created rather than eliminated.

In my earlier U.S. Pat. No. 3,837,820 of Sept. 24, 1974 entitled "Combustion Control by Additives Introduced in Both Hot and Cold Zones", I disclosed that a very effective combustion control could be achieved by burning the fuel in the presence of magnesium or manganese additives in minimal amounts, after which magnesium, usually in the form of a compound such as an oxide, is added to the combustion products at the zone in the furnace which has low temperature relative to the temperature of the combustion zone. That patent taught that several highly advantageous results were achieved thereby, namely, the ash is made less acidic, the hygroscopic nature of the flue gas particulates is reduced, acid smut is effectively eliminated, boiler fouling is reduced because lesser amounts of additive need be applied at the combustion station, and, most importantly, the $SO_3$ content of the flue gas is very radically reduced by as much as 80%.

That manganese is added to the magnesium going into the combustion area, generally in the form of a slurry of magnesium oxide and manganese oxide. The manganese is thought to have the following helpful effects: It destroys carbon and reduces the amount of carbon-containing particulates that leave the superheat area and enter the economizer inlet, it improves the cleanliness of the boiler because it makes it possible to use lesser amounts of magnesium to react with the existing vanadium in the fuel oil, and it reduces sulfur trioxide and acidity. I have now discovered that the benefits of the manganese both as a catalyst and as a synergist for the magnesium optimally takes place only when a limited amount of manganese is added. The effect of manganese in destroying carbon by converting it to $CO_2$ is generally dependent upon the amount of manganese added, so that from that point of view the more manganese added the better. The same considerations would appear to be true in connection with the effect of the manganese in inspiring the magnesium to combine with the vanadium oxides without a build-up of heavy deposits. However, the presence of manganese in the combustion area accelerates the conversion of $SO_2$ to the more harmful $SO_3$. Moreover, the beneficial effects of manganese on the magnesium are also adversely affected if excessive amounts of manganese are present.

In addition, when, in accordance with the present invention, the amount of manganese present in relation to the amount of magnesium is kept within proper limits as here disclosed by reducing the amount of $SO_3$ that reaches the heater inlet, for example, a "cold-end" location, the amount of additive, such as a magnesium compound, which needs to be added at that point in order to reduce the $SO_3$ content of the gas escaping from the stack to an acceptable value is greatly decreased, and this has the further beneficial effect of reducing the total amount of particulates that come out of the stack, since the cold end additives do materially contribute to that particulate content. In my co-pending application, Ser. No. 083,161, entitled "Combustion Control By Addition of Magnesium Compounds of Particular Particle Sizes", I disclose a particularly beneficial cold-end magnesium additive, and the combustion area additives of the present invention are particularly effective when used in conjunction with those improved magnesium cold-end additives, but the present invention is also advantageous when used with specifically different cold-end additives.

The advantageous and unexpected results of the present invention therefore involve the introduction of only a limited amount of manganese into the combustion area along with magnesium, which results in a significant increase in cleanliness and reduction in the amount of carbon particulates, but without increasing $SO_3$ or increasing the deposit on the boiler tubes. Indeed, the amount of $SO_3$ that leaves the combustion area is actually reduced, and hence less cold-end additive, such as magnesium oxide, need be employed.

It is the prime object of the present invention to improve the effects of fuel combustion, particularly with regard to emitting sulfur trioxide in the stack gases and improving the condition of the boilers where the combustion is carried out.

It is a further prime object of the present invention to achieve that improvement through the use of a minimal amount of additive, thereby reducing the expense of the fuel combustion improvement process.

It is another object of the present invention to provide a fuel combustion improvement process which is particularly adaptable for use in conjunction with commercially available fuels, and which can be carried out in existing combustion installations with a minimum of difficulty.

It is a further object of the present invention to provide a process for improving the effects of fuel combustion which inhibits the formation of slag in the boiler and which minimizes the emission of many acid substances in addition to sulfur trioxide.

It is yet another object of the present invention to so improve fuel combustion that the amount of additive needed for cold-end treatment in order to produce acceptable stack emissions is greatly reduced.

The method in question can be used with many different types of fuel and many different types of furnaces. It may be used in oil-fired boilers such as those employed by utility companies, refineries and large industrial plants, with the additive feed to the relatively low temperature zone (hereinafter sometimes called cold-end feed), when employed, occurring at the economizer outlet, for example. The combustion of both residual fuel and crude oil is greatly improved in that manner. The process may also be used with coal-fired and waste gas-fired boilers with a cold-end feed, when employed, occurring at the uptakes, for example. The process is also applicable for use in steel mills burning waste gases, either alone or with Bunker C fuels, by refineries burning waste gas in boilers, and in refinery process heaters burning waste gas or waste gas in combination with Bunker C fuel. This list is not intended to be all-inclusive.

To the accomplishment of the above, and to such other objects as may hereinafter appear, the present invention relates to a method of improving the effects of fuel combustion, as defined in the appended claims and as described in this specification.

In a typical boiler installation, such as the non-recirculating installation shown in FIG. 1 of my aforementioned U.S. Pat. No. 3,837,820 and the recirculating embodiment shown in FIG. 2 thereof, an appropriate fuel, such as fuel oil, coal or combustible gas, is introduced into the furnace in any appropriate manner as through burner guns in the case of fuel oil. Air, preferably heated, is supplied to the furnace in any appropriate manner to combine with the fuel. Combustion of the fuel takes place in the furnace, the portion of the heat energy provided by that combustion being transmitted to the tubes covering the furnace walls, thus converting the water in those tubes to steam. Combustion of the hot gas may be completed by means of the addition thereto of secondary heated air from a heated air duct, air being supplied to that duct from an air inlet by a blower, an air duct, an air preheater and other air ducts. The products of combustion then pass through the platen superheater and reheater, pendant superheater, and horizontal superheater. When the combustion products leave the horizontal superheater their temperature, which in the furnace was about 2,400°-2,800° F., has been reduced to 800°-900° F. The products of combustion then flow through an economizer which pre-heats the water entering the steam-producing tubes inside the furnace. The products of combustion then flow into the gas duct at a temperature of 650°-700° F. They then flow through an air heater which transfers the heat from the exiting gases to an air preheater. At this point the temperature of the products of combustion is approximately 300° F. The products of combustion then flow through precipitators where ash is removed from the stream of gas. The thus cleaned gas flows through a duct and induced draft fan into breeching and then out through the stack.

In my aforementioned U.S. Pat. No. 3,837,820 I disclosed in Examples 6 and 7 the addition of both magnesium and manganese to the fuel oil so that both of those elements were present during combustion, but I have now discovered that the amount of magnesium there used, considered from the point of view of its relationship to the amount of manganese added and to the amount of manganese added per amount of fuel oil, was in fact excessive and deleterious, and that, contrary to conventional thinking, using less magnesium rather than more produced significantly improved overall results. It is important to limit the amount of manganese that is co-added with the magnesium. Comparing the addition of a slurry of magnesium oxide and manganese oxide with the addition of a slurry of magnesium oxide by itself shows that the former provides improved boiler protection at lower additive feed rates—there is less pluggage in the boilers because less solids are added to the boilers, and the manganese has a catalytic effect on the action of the magnesium. What I have discovered is that if certain amounts of manganese are added, which I now know to be excessive, then the synergistic benefits of the manganese on the magnesium are partially nullified because the benefits of manganese as a combustion catalyst are offset by the catalytic effect of manganese as an oxidant to increase the amount of $SO_3$ that forms from the $SO_2$ in the combustion gases. The use of excessive amounts of either manganese or a combination of manganese and magnesium not only increases treatment costs without concomitant advantages but also adversely affects stack emissions both with respect to $SO_3$ and amount and kind of particulates, and also makes for a dirtier boiler requiring more extensive cleaning.

TABLE I

FUEL OIL TREATMENT (MgO and Mn)
Fuel = Bunker C of 200 ppm V, 2.75% S and 0.65% ash
Percent Oxygen = 1.75%

| EXAMPLE | Added to Fuel as Slurry: Mg (lbs./8000 lbs. of Fuel Oil) | Mn (lbs./8000 lbs. of Fuel Oil) | Ratio of Mg:Mn | Total lbs. Mg + Mn per 8,000 lbs. of Fuel Oil | Sulfur Trioxide in Flue Gas (parts per million) | Acidity of Ash Deposits on Air Heater Outlet | Carbon Particulate Concentration (Kg/tons F.O.) | Total lbs. Additive (MnO + MgO) per 8,000 lbs. of fuel equal to lbs. of additive/1000 gals. of fuel |
|---|---|---|---|---|---|---|---|---|
| 1 | — | — | — | — | 35 | 1.9 | 6.5 | — |
| 2 | 0.95 | — | — | 0.95 (Mg only) | 30 | 2.2 | 6.5 | 1.5 (Mg only) |
| 3 | 0.09 | 0.09 | 1.0 | 0.18 | 27 | 2.4 | 5.0 | 0.26 |
| 4 | 0.46 | 0.15 | 3.1 | 0.61 | 10 | 4.0 | 3.5 | 0.95 |
| 5 | 0.79 | 0.26 | 3.1 | 1.1 | 15 | 3.8 | 3.2 | 1.62 |
| 6 | 1.6 | 0.52 | 3.1 | 2.1 | 24 | 3.4 | 3.0 | 3.2 |

Table I compares the use of magnesium oxide by itself with the results obtained by adding magnesium and manganese in different proportions. Example 1 represents the results with no additive at all, in Example 2 magnesium oxide alone was added, and in Examples 3–6 various combinations of magnesium and manganese were added. The use of magnesium oxide by itself showed no reduction of the carbon particulates and a slight reduction of sulfur trioxide. However, using smaller quantities of a combination of magnesium and manganese, as in Examples 3, 4 and 5, brought about a reduction in both the carbon particulates and the sulfur trioxide. The improvement becomes limiting as the total amount of additive feed rate increases. Note that the sulfur trioxide increased from about 10 parts per million in Example 4 to 24 parts per million in Example 6. This is, I believe, due to the increasing amounts of manganese that were used. In Example 4 the sulfur trioxide is minimized, whereas in Example 5, where an undesirable amount of manganese is added, while carbon particulate concentration decreased somewhat the amount of sulfur trioxide actually increased when compared with Example 4; and in Example 6, where even more additive is involved, while the carbon reduction slightly improves, the sulfur trioxide significantly increases, thus indicating the reversal of the synergistic effect of the manganese, the manganese causing the additive to become catalytically active in converting $SO_2$ to $SO_3$.

TABLE II

COMBINATIONS OF MAGNESIUM OXIDE AND MANGANESE OXIDE
TO IMPROVE BOILER CLEANLINESS AND REDUCE AIR HEATER CORROSION
FUEL OIL: Bunker C of 225 ppm V, 2.05% S, and 0.185% ash

| EXAMPLE | Added to Fuel as Slurry: Mg (lbs./1000 gals. of Fuel Oil | Mn (lbs./1000 gals. of Fuel Oil | Ratio of Mg:Mn | Sulfur Trioxide (parts per million) | RESULTS - 6 MOS. TREATMENT: PERCENT REDUCTION OF CARBON | BOILER CLEANLINESS | AIR HEATER CORROSION | STACK APPEARANCE |
|---|---|---|---|---|---|---|---|---|
| 7 | — | — | — | 60 | 0.0 | Corrosion of superheater supports - hard slag. | Highly corroded. | Heavy blue plume - high opacity. |
| 8 | 1.9 | — | — | 50 | Less than 5(%) | Slight corrosion - fairly heavy deposits. | Corroded | Grey-blue cast. |
| 9 | 1.1 | 0.38 | 2.7:1 | 30 | 40 | Clean - no corrosion. | Slight corrosion. | Slight grey cast. |
| 10 | 0.22 | 0.07 | 2.7:1 | 45 | 20 | Some deposits but easily cleaned off. | Signs of corrosion but light. | Slight grey cast - trace of blue. |
| 11 | 1.2 | 0.17 | 7.2:1 | 35 | 35 | Clean - no corrosion. | Slight corrosion. | Slight grey cast. |
| 12 | 0.26 | 0.04 | 7.2:1 | 45 | 15 | Some deposits but easily cleaned off. | Signs of corrosion but light. | Slight grey cast - traces of blue. |
| *13 | 1.1 | 0.38 | 2.7:1 | 25 | 45 | Clean - no corrosion. | No trace of corrosion or deposits. | Very slight opacity - clear stack. |

*In this Example, 1.9 lbs. of powdered MgO per 1000 gals. of fuel oil was added at the Economizer outlet.

Of the examples summarized in Table II, the use of a slurry only of MgO in Example 8 produced a slight reduction of the $SO_3$ but negligible improvement in combustion. In Example 9, where the injected slurry contained both magnesium and manganese, a reduction in $SO_3$ and a very effective reduction in carbon resulted. In Examples 10, 11 and 12, using various amounts of magnesium and manganese within the ratio of 2.7:1 and 7.2:1 of Mg:Mn, there was improvement both in the amount of $SO_3$ formed and the carbon particulates. When, in another experiment the furnace slurry supplied 3.5 pounds of Mg and 1.05 pounds of Mn per 1,000 gallons of fuel oil, producing a Mg:Mn ratio of 3:1, the $SO_3$ content was found to be 70 ppm and the air heaters showed heavy deposits and iron oxide was found in the air heater gas effluent. Optimum performance is shown in Example 13, where MgO powder was added to the air heater inlet after an appropriate combination of Mg and Mn was added to the furnace.

TABLE III

FUEL TREATMENTS
(High Asphaltine Residual Fuels)
Fuel = Bunker C of 245 ppm V, 2.85% S and 0.10% Ash
Percent Oxygen = 4.8%

| EXAMPLE | ADDITION OF: Agent of: | Injection Point | Added to Fuel: Mg (lbs/8000 lbs of Fuel Oil) | Added to Fuel: Mn (lbs/8000 lbs of Fuel Oil) | Ratio of Mg:Mn | Added to Air Heater Inlet (lbs of MgO per 8000 lbs of Fuel Oil) | Sulfur Trioxide in Flue Gas (parts per million) | Acidity of Ash Deposits on Air Heater Outlet (pH) | Carbon Particulate Concentration (Kg/ton Fuel Oil) |
|---|---|---|---|---|---|---|---|---|---|
| 14 | None | — | — | — | — | — | 65.0 | 1.0 | 7.0 |
| 15 | MgO (Powder) | Superheater Inlet | 2.5 | — | — | — | 28.0 | 2.8 | 6.8 |
| 16 | MgO Powder + MnO Powder | Superheater Inlet | 1.0 | 0.25 | 4.0 | — | 32.0 | 2.8 | 4.5 |
| 17 | MgO Powder + MnO Powder + MgO Powder | Superheater Inlet; Air Heater Inlet | 1.0 | 0.25 | 4.0 | 12.0 | 4.9 | 3.7 | 4.5 |
| 18 | MgO Slurry | Fuel Oil | 2.0 | — | — | — | 26.0 | 2.9 | 6.7 |
| 19 | MgO Slurry and MnO Slurry | Fuel Oil | 0.74 | 0.27 | 2.75 | — | 30.0 | 3.0 | 4.2 |
| 20 | MgO Slurry and MnO Slurry Plus MgO Powder | Fuel Oil | 0.74 | 0.27 | 2.75 | 12.0 | 4.6 | 4.0 | 4.2 |
| 21 | MgO Slurry and MnO Slurry | Fuel Oil | 2.22 | 0.81 | 2.75 | — | 45.0 | 2.0 | 3.5 |

In Example 14 the air heaters were heavily corroded and pitted and the stack plume was brownish grey, almost black. In Example 15 the air heaters showed some corrosion and slight deposit pluggage and there was a slight brownish plume. In Example 16 there was slight corrosion of the air heaters and there was only a trace of plume. In Example 17 the air heaters were free of corrosion and the stack had only a slight grey-white cast. Example 16 showed a good carbon reduction but the acidity was still high, while Example 17 showed good results with respect to carbon reduction and acidity. In Example 18 the air heaters showed some corrosion and sticky deposits, the plume had a slight greyish cast, $SO_3$ was reduced but there was no appreciable effect on carbon. In Example 19 the air heaters showed slight corrosion, the stack was clear with only a trace of plume, the carbon reduction was good, acidity was still high and $SO_3$ content was still high. In Example 20 the air heaters were clean and free of corrosion, the stack effluent had only a slight grey-white cast, the carbon reduction was significant as was the acidity. In Example 21 the air heaters showed signs of pitting and corrosion, there was a slight blue stack plume, carbon reduction was excellent but acidity was high as measured by $SO_3$ content and pH. Example 20 represents the ideal situation.

Experiments with varying amounts and proportions of magnesium and manganese when added to the fuel being burned, as typified by the above examples, reveals that, contrary to the previously existing belief that manganese could be used in virtually unlimited amunts except as dictated by economic factors, in fact the magnesium and manganese should be present in proportions by weight between 2.7:1 and 7.5:1, with the amount of manganese not exceeding 0.4 pound per 8,000 pounds of fuel oil or its equivalent, with the manganese preferably being present in an amount greater than 0.03 pound per 8,000 pounds of fuel oil or its equivalent. When the Mg:Mn ratio is 2.7:1 the Mg should be present in an amount between 0.19 and 1.1 pounds and the manganese should be present in an amount between 0.07 and 0.4 pound; when the Mg:Mn ratio is 7.5:1 the Mg is present in an amount between 0.22 and 1.2 pounds and the Mn is present in an amount between 0.3 and 1.6 pounds, and when the Mg:Mn ratio is between those two values the respective amounts of Mg and Mn correspondingly vary, all of those amounts being in terms of pounds per 8,000 pounds of fuel oil or its equivalent.

As has been pointed out, when the magnesium and manganese are present during combustion in accordance with the teachings here set forth, with addition of magnesium in particulate form to the products of combustion at a low temperature area prior to exhaust, preferably but not necessarily in accordance with the teachings in my aforementioned co-pending application, lesser amounts of magnesium need be there added to achieve desired results than would be the case if the magnesium and manganese were not present at combustion in accordance with the above teachings.

The additives used in accordance with the present invention may contain substances other than the magnesium-containing substances here specified, those other substances sometimes adding combustion control effects of their own and sometimes enhancing the effect of the magnesium here involved.

While this invention has been described in terms of the use of magnesium and manganese in the form of their oxides, other compounds, and in particular the hydroxides and compounds which under the conditions to which they are subjected in accordance with these teachings convert or decompose to the oxides or hydroxides, may also be employed, and the terms "magnesium compound" and "manganese compound" as here used encompasses all of such substances.

While only a limited number of embodiments of the present invention have been here specifically described, it will be apparent that many variations may be made therein, all without departing from the spirit of the ivention as defined in the following claims.

I claim:

1. In the operation of a fuel burning system having a fuel burning furnace and means for conveying the products of combustion from the furnace to exhaust, and in which the fuel is burned in the presence of an additive comprising a combination of magnesium and manganese, the improvement which comprises the magnesium and manganese being present in proportions by weight between 2.7:1 and 7.5:1 and the amount of manganese does not exceed 0.4 pounds per 8,000 pounds of fuel oil or its equivalent.

2. The improvement of claim 1, in which the amount of manganese is greater than 0.03 pounds per 8,000 pounds of fuel oil or its equivalent.

3. The improvement of claim 1, in which, when the Mg:Mn ratio is 2.7:1 the Mg is present in an amount between 0.19 and 1.1 pounds and the Mn is present in an amount between 0.07 and 0.4 pound, when the Mg:Mn ratio is 7.5:1 the Mg is present in an amount between 0.22 and 1.2 pounds and the Mn is present in an amount between 0.03 and 0.16 pound, and when the Mg:Mn ratio is between those two values the respective amounts of Mg and Mn correspondingly vary, the specified amounts being in terms of pounds per 8,000 pounds of fuel oil or its equivalent.

4. In the operation of the fuel burning system of any one of claims 1–3, the addition of magnesium in particulate form to the products of combustion at a low temperature area prior to exhaust.

* * * * *